United States Patent [19]

Nishiyama

[11] 4,270,578

[45] Jun. 2, 1981

[54] HARNESS FOR LOOMS

[75] Inventor: Hissai Nishiyama, Hayahoshi, Japan

[73] Assignee: Yoshida Kogyo K. K., Tokyo, Japan

[21] Appl. No.: 52,250

[22] Filed: Jun. 26, 1979

[30] Foreign Application Priority Data

Jul. 13, 1978 [JP] Japan ..... 53-96429

[51] Int. Cl.[3] ..... D03C 9/06

[52] U.S. Cl. ..... 139/92

[58] Field of Search ..... 139/91, 92; 24/73 R, 24/73 SB

[56] References Cited

U.S. PATENT DOCUMENTS

| | | | |
|---|---|---|---|
| 1,009,050 | 11/1911 | Cote | 139/92 |
| 1,526,159 | 2/1925 | Livermore | 139/92 |
| 2,634,763 | 4/1953 | Consoletti | 139/92 |
| 2,700,399 | 1/1955 | Pfarrwaller | 139/92 |
| 2,955,619 | 10/1960 | Flamand | 139/92 |
| 3,169,555 | 2/1965 | Koyder et al. | 139/91 |
| 3,752,194 | 8/1973 | Griffith | 139/91 X |

FOREIGN PATENT DOCUMENTS 956364 4/1964 United Kingdom .

*Primary Examiner*—Henry Jaudon

*Attorney, Agent, or Firm*—Hill, Van Santen, Steadman, Chiara & Simpson

[57] ABSTRACT

A harness for narrow-fabric weaving looms comprises a plurality of heddles, and a rectangular heddle frame including first and second pairs of heddle-supporting bars projecting from opposed vertical frame sides toward and terminating short of each other, the heddles being divided into two groups carried separately by the first and second pair of bars at opposite ends of each heddle. The harness further includes a pair of connectors each connecting one of the first pair of bars and one of the second pair of bars at their free ends, thereby preventing the heddle-supporting bars from shaking or vibrating during weaving.

8 Claims, 7 Drawing Figures

HARNESS FOR LOOMS

BACKGROUND OFTHE INVENTION

1. Field of the Invention

The present invention relates generally to narrow-fabric weaving looms, and more particularly to a harness for such looms.

2. Prior Art

Known harnesses for narrow-fabric weaving looms generally include a heddle frame with two pairs of heddle-supporting bars on which a plurality of heddles are mounted. Each of the heddle-supporting bars is supported as a cantilever only at one end by the heddle frame. A common problem encountered with the known harnesses is that the free ends of the heddle-supporting bars are liable to vibrate severely as the heddle frame is reciprocated vertically during weaving, thus often causing these bars as well as the heddles thereon to become broken or otherwise deformed.

SUMMARY OF THE INVENTION

It is therefore an object of the present invention to provide a harness for looms which can prevent heddle-supporting bars from shaking or vibrating during weaving.

According to the present invention, a harness for looms has a pair of connectors each connecting ends of opposed cantilevered heddle-supporting bars of a rectangular heddle frame at their free ends. Each of the connectors comprises a snap hook at its one marginal end, a pair of first and second flanges at the other marginal end, and a protuberance positioned between the snap hook and the flange pair. The snap hook coacts with the protuberance to hold therebetween one of opposed horizontal sides of the rectangular frame. One of the first pair of heddle-supporting bars and one of the second pair of heddle-supporting bars are held between the first flange and the protuberance and between the latter and the second flange, respectively. The connectors eliminate any objectionable resonant or induced vibration of the heddle-supporting bars by gripping their free ends.

According to a second embodiment, each of the connectors includes an elongate strip having a snap hook at its one marginal end, and a pair of first and second flanges at the other marginal end which coact with the snap hook to hold one of the first pair of heddle-supporting bars and one of the second pair of heddle-supporting bars between the first flange and the snap hook and between the latter and the second flange, respectively.

Many other advantages, features and additional objects of the present invention will become manifest to those versed in the art upon making reference to the detailed description and the accompanying drawings in which preferred structural embodiments incorporating the principles of the present invention are shown by way of example.

DETAILED DESCRIPTION

Figure 1:
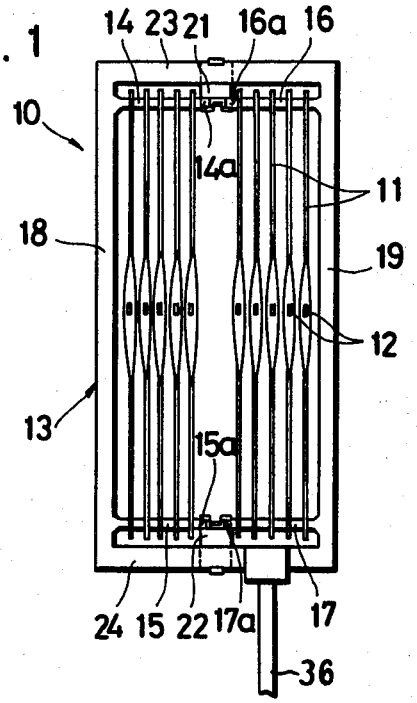
FIG. 1 is a front elevational view of a harness for looms according to the present invention.

As shown in FIG. 1, a harness 10 for looms comprises a plurality of heddles 11 (ten in the illustrated embodiment) each having an eyelet 12 in its center through which a warp thread may pass in weaving, and an open heddle frame 13 supporting the heddles 11. The heddle frame 13 is generally rectangular, and includes first and second pairs of heddle-supporting bars 14,15 and 16,17 which project perpendicularly from and are supported as cantilevers by opposed vertical frame sides 18,19, respectively. The first pair of (upper and lower) bars 14,15 extends toward and terminates short of the second pair of (upper and lower) bars 16,17, respectively, and vice versa.

The heddles 11 are divided into two groups carried separately by the first and second pairs of bars 14,15 and 16,17. Each heddle 11 has a pair of loops or holes 20,20 (FIG. 2) in its opposite ends, through which the first pair of upper and lower bars 14,15 (or the second pair of upper and lower bars 16,17), respectively, extend loosely. Thus, the heddles 11 are supported between the first pair of bars 14,15 and between the second pair of bars 16,17.

Figure 3:
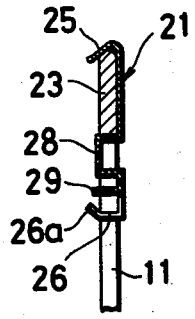
FIG. 3 is a cross-sectional view taken along line III—III of FIG. 2.
Figure 4:
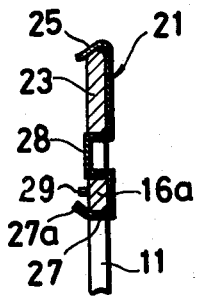
FIG. 4 is a cross-sectional view taken along line IV—IV of FIG. 2.
Figure 5:
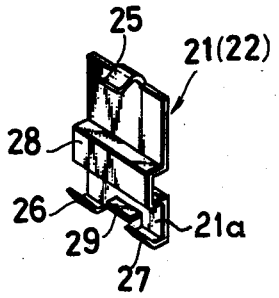
FIG. 5 is a perspective view of the connector shown in FIG. 2.

The harness 10 further comprises a pair of upper and lower identical connectors 21,22 mounted on a pair of opposed horizontal frame sides 23,24, respectively, and connecting the opposed upper bars 14,16 together at their free ends **14*a*,16*a* and the opposed lower bars 15,17 at their free ends 15*a*,17*a*, respectively. Each of the connectors 21,22 is made of a strip of a resilient metal or a rigid synthetic resin. As best shown in FIG. 5, each of the connectors 21,22 has a snap hook 25 at one end, and a pair of laterally spaced first and second flanges 26,27 at the other end secured to an elongate base 21*a*. Positioned between the snap hook 25 and the pair of first and second flanges 26,27 is an elongate projecting means or protuberance 28 extending horizontally as shown for the full width of the connector. For each connector 21(22), one of the opposed horizontal frame sides 23(24) is gripped by resilient gripping means, namely between the snap hook 25 and the protuberance 28, while the free ends 14*a*,16*a* of the upper bars 14,16 (the free ends 15*a*,17*a* of the lower bars 15,17) are gripped between the first flange 26 and the protuberance 28 and between the latter and the second flange 27, respectively. Each of the first and second flanges 26,27 has a slightly inwardly bent marginal end 26*a*,27*a* (FIGS. 3 and 4) which prevents one of the opposed bars 14,16 (15,17) from accidentally shifting out of position in a direction perpendicular to the general plane of the heddle frame 13** as the latter is reciprocated vertically during weaving.

Figure 2:
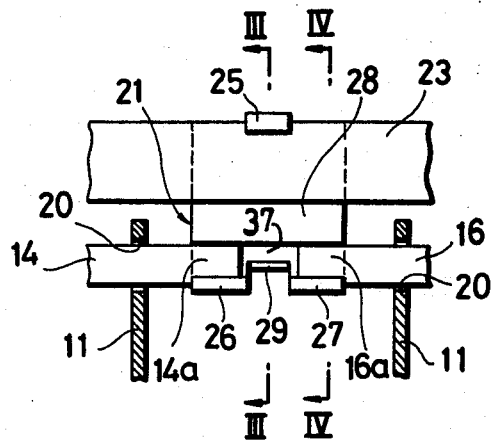
FIG. 2 is an enlarged, fragmentary front elevational view, partly in cross-section, of the harness of FIG. 1, showing a connector for opposed heddle-supporting bars.

Each connector 21,22 also has a tongue 29 which is positioned between the first and second flanges 26,27 and spaced from the protuberance 28. As best shown in FIG. 2, the tongue 29 projects into a space 37 between the free ends 14*a* and 16*a* (15*a* and 17*a*) of the opposed bars 14 and 16 (15 and 17) so that each connector 21,22 can be limited to shifting in a transverse direction of the heddle frame 13. Because of the snap hook 25, each connector 21,22 mounted on the heddle frame 13 can be protected from being accidentally moved out of place. Vertical reciprocation by a drive means 36 of the harness 10 imparts vibrations to the heddle-supporting bars 14–17 corresponding to an unknown or uncertain operating frequency including other vibration frequencies and/or harmonics originating elsewhere in the loom and transmitted by the drive means 36. To preclude any induced or resonant vibration of the bars 14–17, the connectors 21, 22, in gripping the free ends of the bars 14–17, preclude such potentially harmful vibration. Yet, they are removable to facilitate replacement of any of the heddles 11. During the restraint of minor vibration, the free ends of the bars tend to move inwardly and outwardly of the connectors, and any ultimate differential displacement is precluded by the tongue 29, whereby inadvertent disconnection is averted.

Figure 7:
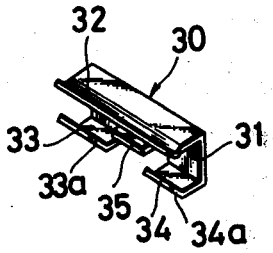
FIG. 7 is a perspective view of a connector for opposed heddle-supporting bars of the modified harness of FIG. 6.
Figure 6:
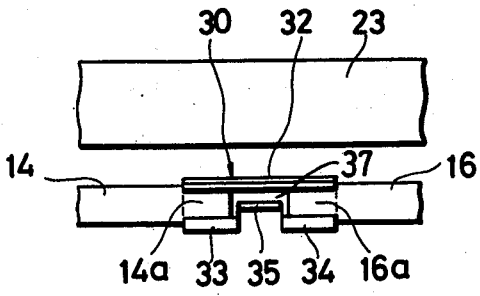
FIG. 6 is a fragmentary front elevational view of a modification of the harness.

According to a second embodiment illustrated in FIGS. 6 and 7, the opposed bars 14 and 16 (15 and 17) are held together at the free ends 14*a* and 16*a* (15*a* and 17*a*) by one of a pair of modified connectors 30, only one of which is illustrated herein. Each of the connectors 30 is in the form of a horizontally elongated strip of a C-shaped transverse cross section, and has an elongate base 31, a snap hook 32 projecting substantially perpendicularly from an upper edge of the base 31, and a pair of laterally spaced first and second flanges 33,34 projecting perpendicularly from a lower edge of the base 31. The free ends 14*a* and 16*a* (15*a* and 17*a*) of the opposed bars 14 and 16 (15 and 17) are gripped between the first flange 33 and the snap hook 32 and between the latter and the second flange 34, respectively. Each of the first and second flanges 33,34 has a slightly inwardly bent marginal end 33*a*,34*a* which coacts with the snap hook 32 to prevent one of the opposed bars 14,16 (15,17) from being accidentally shifted out of position in a direction perpendicular to the general plane of the heddle frame 13 as the latter is reciprocated vertically during weaving.

Each connector 30 also has a tongue 35 which is identical to that of the first described embodiment in both construction and function. Thus, the opposed bars 14 and 16 (15,17) are connected together by the connector 30(30) and are thereby prevented from vibrating during weaving.

Although various minor modifications may be suggested by those versed in the art, it should be understood that I wish to embody within the scope of the patent warranted thereon all such embodiments as reasonably and properly come within the scope of contribution to the art.

What I claim is:

1. A harness for looms comprising, in combination:

(a) a plurality of heddles;

(b) a rectangular heddle frame including first and second pairs of bars projecting from opposed vertical sides of said rectangular frame toward and terminating short of each other, said heddles being divided into two groups carried separately by said first and second pairs of bars at opposite ends of each heddle; and (c) a pair of connectors each connecting and bridging one of said first pair of bars and one of said second pair of bars at their free ends, each said connector having a snap hook engageable with one of said first pair of bars and one of said second pair of bars.

2. A harness according to claim 1, each said connector having a pair of first and second flanges which coact with said snap hook to hold one of said first pair of bars and one of said second pair of bars between said first flange and said snap hook and between the latter and said second flange, respectively.

3. A harness according to claim 2, each of said first and second flanges having a slightly inwardly bent marginal end.

4. A harness for looms comprising:

(a) a centrally open frame having a first pair and a second pair of heddle-support bars, each pair spaced from the other pair and extending as cantilevers from opposite sides of said frame toward each other;

(b) a plurality of heddles, each carried on two of said heddle-support bars; and (c) a pair of connectors each connecting and bridging the free ends of said first and second heddle-support bars respectively, each of said connectors comprising:

(1) an elongate base having (2) a pair of flanges projecting from an edge thereof, and (3) means projecting from an opposite edge thereof, (4) said flanges and said projecting means jointly gripping said free ends.

5. A harness for looms comprising, in combination:

(a) a plurality of heddles;

(b) a rectangular heddle frame including first and second pairs of bars projecting from opposed vertical sides of said rectangular frame toward and terminating short of each other, said heddles being divided into two groups carried separately by said first and second pair of bars at opposite ends of each heddle; and (c) a pair of connectors each connecting one of said first pair of bars and one of said second pair of bars at their free ends, each of said connectors including an elongate strip of a C-shaped transverse cross section, and said strip having a tongue projecting into a space between the free ends of such opposed pair of bars.

6. A harness for looms comprising, in combination:

(a) a plurality of heddles;

(b) a rectangular heddle frame including first and second pairs of bars projecting from opposed vertical sides of said rectangular frame toward and terminating short of each other, said heddles being divided into two groups carried separately by said first and second pair of bars at opposite ends of each heddle; and (c) a pair of connectors each connecting one of said first pair of bars and one of said second pair of bars at their free ends; each of said connectors having a snap hook at its one end, a pair of first and second flanges at the other end, and a protuberance positioned between said snap hook and said flanges, said snap hook coacting with said protuberance to hold therebetween one of opposed horizontal sides of said rectangular frame, one of said first pair of bars and one of said second pair of bars being held between said first flange and said protuberance and between the latter and said second flange, respectively.

7. A harness for looms, comprising:

(a) a centrally open frame having a first pair and a second pair of heddle-support bars, each pair spaced from the other pair and extending as cantilevers from opposite sides of said frame toward each other;

(b) a plurality of heddles, each carried on two of said heddle support bars; and (c) a pair of connectors each connecting the free ends of said first and second heddle-support bars respectively, each of said connectors comprising (1) an elongate base having (2) a pair of flanges projecting from an edge thereof, each of said flanges having a slightly inwardly directed marginal end, and (3) means projecting from an opposite edge thereof, (4) said flanges and said projecting means jointly gripping said free ends.

8. A harness for looms, comprising:

(a) a centrally open frame having a first pair and a second pair of heddle-support bars, each pair spaced from the other pair and extending as cantilevers from opposite sides of said frame toward each other;

(b) a plurality of heddles, each carried on two of said heddle support bars; and (c) a pair of connectors each connecing the free ends of said first and second heddle-support bars respectively, each of said connectors comprising (1) an elongate base having (2) a pair of flanges projecting from an edge thereof, (3) means projecting from an opposite edge thereof, (4) said flanges and said projecting means jointly gripping said free ends, and (5) a tongue projecting from said base into a space between the free ends of said heddle-support bars.

* * * * *